United States Patent [19]

Chronberg

[11] 4,092,231

[45] May 30, 1978

[54] METHOD OF PREPARING BY ELECTROPHORESIS A SHAPED ARTICLE CONSTITUTED BY AGGLOMERATED PARTICLES AND A DEVICE FOR CARRYING OUT THE SAID METHOD

[75] Inventor: Sten Chronberg, Arnieres-sur-Iton, France

[73] Assignee: Agence Nationale de Valorisation de la Recherche (ANVAR), France

[21] Appl. No.: 778,387

[22] Filed: Mar. 17, 1977

[30] Foreign Application Priority Data

Mar. 23, 1976 France ..... 76 08388

[51] Int. Cl.[2] ..... C25D 1/14; C25D 1/20; C25D 13/00

[52] U.S. Cl. ..... 204/181 F; 204/300 EC

[58] Field of Search ..... 204/181, 300 EC

[56] References Cited

U.S. PATENT DOCUMENTS

| | | | |
|---|---|---|---|
| 3,718,564 | 2/1973 | Ebrey et al. | 204/181 |
| 3,898,146 | 8/1975 | Rehkoff et al. | 204/181 |

*Primary Examiner*—Howard S. Williams

*Attorney, Agent, or Firm*—Steinberg & Blake

[57] ABSTRACT

A method and apparatus for preparing a shaped article by electrophoresis, said article being formed by agglomerated particles deposited on electrodes from a suspension in a liquid, wherein said suspension is supplied into a space defined between two confronting electrodes in the form of a concave portion and of a convex portion of said article, respectively, wherein said suspension is subjected to an electrophoresis effect between said electrodes which are subjected to a given voltage while an adjacent counterelectrode is subjected to another voltage, and wherein said electrodes are moved closer to one another so as to join and compress together corresponding deposits, for thus forming said article.

12 Claims, 5 Drawing Figures

Figure 1:
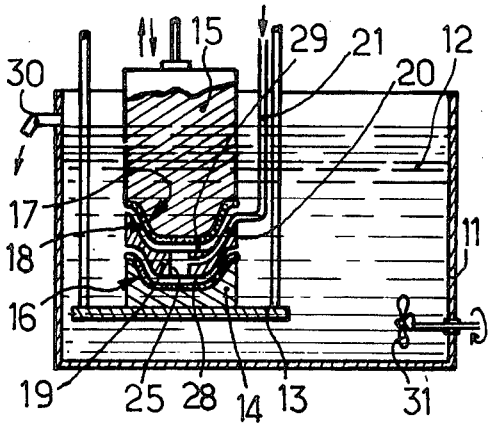

METHOD OF PREPARING BY ELECTROPHORESIS A SHAPED ARTICLE CONSTITUTED BY AGGLOMERATED PARTICLES AND A DEVICE FOR CARRYING OUT THE SAID METHOD

The present invention relates essentially to the preparation by electrophoresis of a shaped article, i.e. an article that is not flat and is more or less complex in shape, such as for example a vase or a dish, constituted by particles agglomerated together, such as solid or plastic particles, from a suspension in a liquid, the said article having, after separation, sufficient cohesion to allow its subsequent use by every known working method or technique. The invention is particularly directed to the preparation, prior to firing or baking, of such articles in the ceramic or pottery industry, in which case the said article is obtained from a suspension of clay in water, known in the art as "barbotine". The principle of the invention may also be used for the manufacture of articles of paper, board, agglomerated fibre, etc.

The use is known of electrophoresis for forming articles of complex shapes. This method consists in providing a deposit of agglomerated particles on an electrode, the particles being preferably suspended in a liquid medium and the said electrode substantially reproducing the shape of the desired article. For example, articles of clay of more or less complex shapes may be formed by anaphoresis (i.e. by performing the electrophoretic deposition on an anode) from a suspension of barbotine in water, on a metal anode of suitable shape, e.g. a zinc anode. When the deposit has reached the desired thickness, it is separated from the anode which can then be re-utilized for preparing another similar article. The voltage which must create the electric field near the anode is applied between the said anode and a cathode located in proximity to the latter. A difference of potential of a few tens of volts between the two electrodes is generally sufficient to provide the desired deposit.

Such a method, however, suffers from a major disadvantage when it is desired to obtain objects of a certain thickness, especially ceramic objects which may subsequently be subjected to firing or baking. Indeed, a certain increasing resistance is offered by the deposit to the flow of current between the two electrodes as the deposition proceeds. The corresponding electrophoresis field also diminishes progressively, resulting in a deposit the density and cohesion of which diminish as the fresh deposit layers are farther from the anode. The internal stresses produced in the shaped article by this density unbalance may cause strain or deformation during subsequent processing, particularly during firing or baking in the production of ceramic articles. The present invention allows this drawback to be avoided.

The invention therefore relates to a method of preparing by electrophoresis a shaped article constituted by particles agglomerated together, such as solid or plastic particles, based in particular on clay, from a suspension in a liquid such as for example water, the said article having sufficient cohesion to allow its subsequent working by any known method or technique, in particular its processing into a ceramic product, characterized in that the suspension, such as in particular barbotine, is supplied into a space defined between two electrodes in mutually confronting relationship, the mutually confronting portions of which have substantially the shape of the said article, i.e. the shape of its indented or concave portion and of its raised or convex portion, respectively. The suspension in the said space is subjected for a certain time to an electrophoresis effect between the said electrodes which are subjected to a given voltage while an adjacent counterelectrode subjected to a different voltage. The said electrodes is are moved towards one another when the electrophoretic deposits have reached a desired thickness thereon, so as to join and press the said deposits together, after which the said electrodes are again moved apart to release the article thus formed.

Thus, the provision of two deposits on two electrodes of complementary shape allows the thickness of the deposits to be reduced by half (in order to obtain an article of predetermined thickness) compared with the thickness which would be necessary if it were desired to form the same article on a single electrode. This feature allows variations in density to be reduced. In addition, by moving the two layers towards one another and joining them together the barbotine comprised between the two deposited layers is expelled and at the same time a mutual counter-balancing of the mutually opposite internal stresses possibly present in the two layers is obtained.

The step consisting in joining and pressing together the two layers is preferably entirely performed in the liquid barbotine bath, thus avoiding the insertion of air bubbles between the two layers joined together, which would be highly detrimental to the quality of the ceramic product obtained.

The invention also has for its object a device for preparing by electrophoresis a shaped article constituted by particles agglomerated together, such as solid or plastic particles, based in particular on clay, from a suspension in a liquid such as in particular water, the said article having sufficient cohesion to allow its subsequent working by any known method or technique with a view in particular to its processing into a ceramic product, characterized in that it comprises two electrodes the space between which is adjustable and which are arranged in a tank containing barbotine to define a space between their mutually confronting portions, the said mutually confronting portions having substantially the shape of the said article, i.e. the shape of its indented or concave portion and of its raised or convex portion, respectively, a counter-electrode arranged in proximity to the said space and preferably within the latter, and means for applying a difference of potential of a selected value between the said electrodes on the one hand and the said counter-electrode on the other hand.

The invention will be better understood and other purposes, details and advantages of the latter will appear more clearly from the following explanatory description of a preferred form of embodiment of a device according to the invention, given solely by way of example with reference to the appended non-limitative drawing wherein:

FIGS. 1 to 5 show very diagrammatically a device designed according to the invention and illustrated partially in section during the various stages of its operation and according to their logical sequence.

The device is composed essentially of a tank 11 containing barbotine 12 and a vertically movable lifting plate 13 supporting an electrode 14. Another electrode 15 is arranged above the electrode 14 and is also displaceable vertically by means of suitable lifting means (not shown). The spacing between the two mutually confronting portions 16 and 17 of electrodes 14 and 15, respectively, is thus adjustable at will. The mutually confronting portions 16 and 17 define between themselves a space 18 (of variable size according to the spacing between the electrodes) capable of accommodating a counter-electrode 19. The latter is adapted to move laterally within the tank 11 by any appropriate means and may thus be introduced into the space 18. The portion 16 of electrode 14 has substantially the indented or concave shape of the article to be formed, whereas the portion 17 of electrode 15 has substantially the raised or convex shape of the same article. The connter-electrode 19 is provided with an internal duct 20 prolonged outside the tank by a duct 21 into which barbotine of the desired composition can be injected. The duct 20 opens at the center of the counter-electrode 19, on either side of its opposite faces 22, 23 intended to be placed in confronting relationship to the portions 16, 17 respectively, when the device is in the electrophoresis stage proper (FIG. 1). To this end a through passage 25 is provided in the central region of the counter-electrode 19 and the duct 20 opens into the passage 25. Furthermore, the opposite faces 22, 23 also have substantially the shape of the article to be formed, the face 22 having its raised or convex shape and being intended to be placed in confronting relationship to the electrode 14 provided with and indented or concave portion 16, whereas the face 23 having and indented or concave shape is intended to be placed in confronting relationship to the electrode 15 provided with a raised or convex portion 17. In this manner when both electrodes 14, 15 and the counter-electrode 19 are correctly arranged with respect to one another in order to perform the electrophoresis stage (FIG. 1) two gaps 28, 29 are obtained in the space 18 with a substantially uniform spacing between each electrode 14, 15 and the counter-electrode 19, respectively. This allows a perfectly uniform electric field to be obtained between the electrodes and the counter-electrode during the electrophoresis, and therefore to achieve a perfectly regular deposit. The excess barbotine 12 is discharged through an overflow 30 before being recycled and the barbotine in the tank 11 is continuously stirred by any known means such as a paddle agitator 31. The electrodes 14 and 15 are connected (not shown) to the positive pole of a direct-current supply (not shown), whereas the negative pole of the latter is connected to the counter-electrode 19. The operation of the device just described is quite simple and is obviously from the foregoing description.

Barbotine of optimum composition and consistency for electophoresis is first prepared outside the tank. In fact the barbotine is essentially a mixture of clay, electrolyte and water which are suitably mixed to obtain the desired suspension of clay in the liquid phase. It is this "fresh" barbotine that is freed at the time of electrophoresis (FIG. 1) in the very middle of the space 18 since it is injected through the ducts 21, 20 and the passage 25. When a suitable difference of potential is applied between the electrodes 14, 15 (anodes) on the one hand and the counter-electrode 19 (cathode) on the other hand, the barbotine which is naturally expelled from the gaps 28 and 29 by the continuous inflow of "fresh" barbotine escapes from the passage 25 at both sides of the counter-electrode 19 and becomes reduced in concentration of clay, which is deposited uniformly on the portions 16 and 17 of the electrodes. Thereafter the excess barbotine becomes diluted in the tank 11 and is discharged through the outlet 30 in order to be regenerated and recycled.

Figure 2:
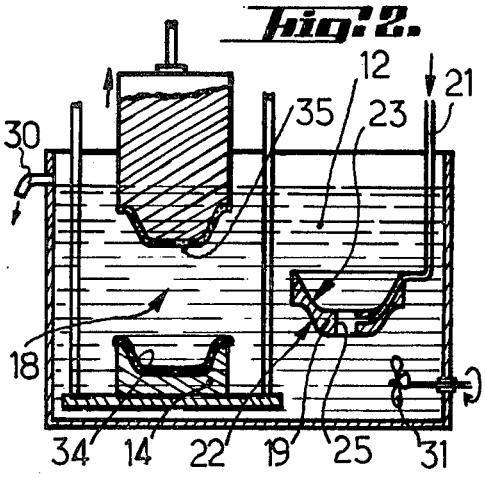
Figure 3:
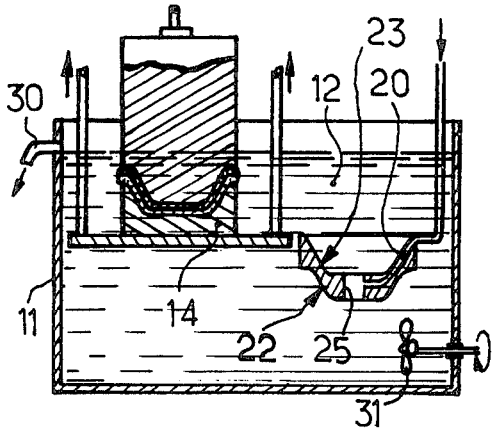
Figure 4:
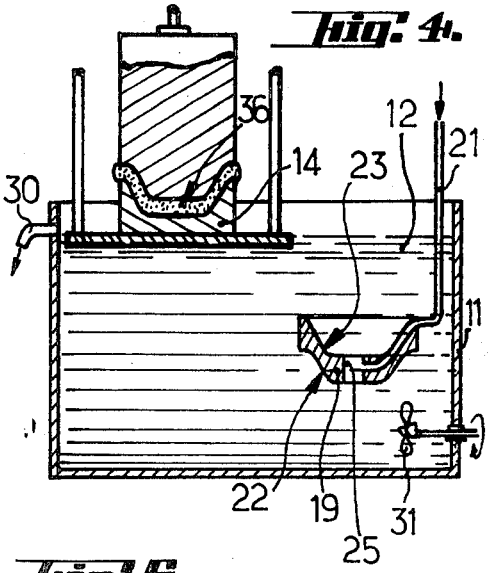
Figure 5:
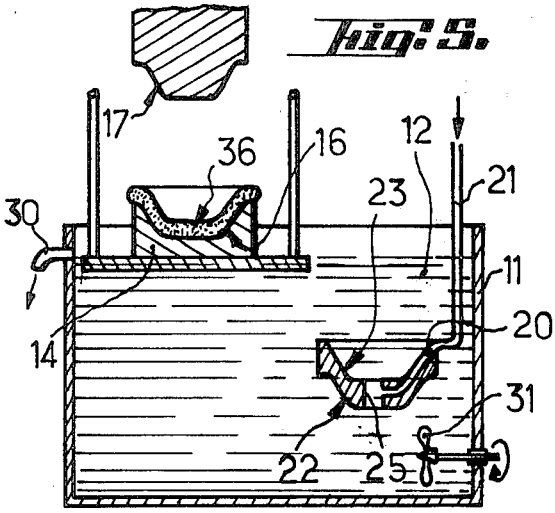

When both deposits 34 and 35 have reached the desired thickness, the electrophoresis is discontinued and the electrodes 14 and 15 are moved further apart to allow the counter-electrode 19 to be removed from the space 18 (FIG. 2). Thereafter the two electrodes are moved closer to one another (FIG. 3) so as to join the deposits 34 and 35 together and to eliminate the barbotine comprised between the two deposits. As mentioned earlier, a mutual counter-balancing of the stresses which may be present within the formed article 36 is thus ensured even if the thickness of the article is relatively great. Furthermore, it can be noted that the operation diagrammatically shown in FIG. 3 is entirely performed in the liquid bath contained in the tank 11, thus avoiding any insertion of air bubbles between the layers 34 and 35 which are joined together. Thereafter the assembly constituted by both electrodes 14 and 15 and article 36 is withdrawn from the tank 11 by means of the lifting plate 13 (FIG. 4) and then the electrode 15 itself is raised additionally to release the article 36 (FIG. 5). In order to form a further article of the same nature it is sufficient to again lower the electrodes 14 and 15 into the tank until they reach their respective positions shown in FIG. 2, to reintroduce laterally the counter-electrode 19 into the space 18 and to move the said electrodes closer to the counter-electrode 19 to the respective positions in which the constant gaps 28 and 29 are reconstituted. This leads to the situation illustrated in FIG. 1, in which the electrophoresis can be carried out.

Of course, the invention is by no means limited to the method and device just described, since it comprises all the technical equivalents if the latter are used in the scope of the following claims.

What is claimed is:

1. A method of preparing by electrophoresis a shaped article constituted by particles agglomerated together from a suspension in a liquid, the said article having sufficient cohesion to allow its subsequent working by any known method or technique, characterized in that the suspension is supplied into a space defined between two mutually confronting electrodes, the mutually confronting portions of which have substantially the shape of the said article, i.e. the shape of its indented or concave portion and of its raised or convex portion, respectively, the suspension in the said space is subjected for a certain time to an electrophoresis effect between the said electrodes which are subjected to a given voltage and an adjacent counter-electrode which is subjected to a different voltage, the said electrodes are moved closer to one another, when the electrophoretic deposits have reached a desired thickness thereon, so as to join and compress together the said deposits, and thereafter the said electrodes are moved apart to release the said article thus formed.

2. A method according to claim 1, characterized in that the step consisting in moving the said electrodes closer to one another to join the said deposits together is performed in a liquid bath.

3. A method according to claim 1, characterized in that the said counter-electrode is arranged in the said space in order to perform the electrophoresis and that it is withdrawn before the said electrodes are moved closer to one another.

4. A method according to claim 1, characterized in that suspension is introduced substantially into the central region of the said space during the electrophoresis stage.

5. A method according to claim 2, characterized in that the said electrodes fulfill the function of anodes, whereas the said counter-electrode fulfills the function of a cathode.

6. A method according to claim 1, characterized in that both electrodes are introduced vertically into a barbotine bath, the said electrodes being separated so as to define a space between their mutually confronting portions, the said counter-electrode is introduced into the said space, the said electrodes are moved closer to the said counter-electrode so as to define two gaps between said electrodes and the said counter-electrode, respectively, the said barbotine in the said space is subjected to the said electrophoresis effect, the said electrodes are moved apart in order to withdraw the said counter-electrode from the said space, the said electrodes are then moved closer to one another until the said deposits are joined and compressed together to thus form the said article, the said electrodes and the said article are withdrawn from the said bath, after which said electrodes are moved apart to release the said article.

7. A device for preparing by electrophoresis a shaped article constituted by particles agglomerated together from a suspension in a liquid, the said article having sufficient cohesion to allow its subsequent working by any known method or technique, characterized in that it comprises two electrodes the spacing between which is adjustable and which are arranged in a tank adapted to contain a barbotine bath so as to define a space between their mutually confronting portions, the said confronting portions having substantially the shape of the said article, i.e. the shape of its indented or concave portion and of its raised or convex portion, respectively, and a counter-electrode arranged in said space, so that upon applying a difference of potential of a selected value between the said electrodes on the one hand and the said counter-electrode on the other hand, deposits will form on said mutually confronting portions of said electrodes.

8. A device according to claim 7, characterized in that it comprises means for continuously stirring or agitating the barbotine bath in the said tank.

9. A device according to claim 7, characterized in that it comprises lifting means for withdrawing the said electrodes from the said tank or for varying their respective position in the latter.

10. A device according to claim 8, characterized in that it comprises means for laterally introducing the said counter-electrode into the said space.

11. A device according to claim 7, characterized in that the said counter-electrode has two opposite faces having substantially the shape of the said article, i.e. the shape of its indented or concave portion and of its raised or convex portion, respectively, the indented or concave face of the said counter-electrode being intended to be placed in confronting relationship to the electrode having a raised or convex portion and the raised or convex face of the said counter-electrode being intended to be placed in confronting relationship to the electrode having an indented or concave portion, so as to define in the said space two substantially uniform gaps between said electrodes and the said counter-electrode, respectively.

12. A device according to claim 11, characterized in that the said counter-electrode is provided with an internal barbotine-supply duct opening substantially into its central region at both of its faces intended to be placed opposite the said mutually confronting portions of the said electrodes during electrophoresis.

* * * * *